United States Patent [19]

Kaplan

[11] 4,100,452

[45] Jul. 11, 1978

[54] COLOR TELEVISION PICTURE TUBE IMAGE SCREEN HAVING POSITIVE AND NEGATIVE MISREGISTRATION TOLERANCE CONDITIONS

[75] Inventor: Sam H. Kaplan, Chicago, Ill.

[73] Assignee: Zenith Radio Corporation, Glenview, Ill.

[21] Appl. No.: 737,961

[22] Filed: Nov. 2, 1976

[51] Int. Cl.[2] ..... H01J 29/07; H01J 29/32; H01J 31/20

[52] U.S. Cl. ..... 313/408; 313/470

[58] Field of Search ..... 313/408, 472

[56] References Cited

U.S. PATENT DOCUMENTS

| | | | |
|---|---|---|---|
| Re. 26,251 | 8/1967 | Kaplan | 313/408 |
| 3,146,368 | 8/1964 | Fiore et al. | 313/408 |
| 3,569,761 | 3/1971 | Lange | 313/408 |
| 3,890,527 | 6/1975 | Patel et al. | 313/408 |
| 3,988,632 | 10/1976 | Dietch | 313/402 |

FOREIGN PATENT DOCUMENTS

| | | | |
|---|---|---|---|
| 1,348,677 | 8/1971 | United Kingdom | 313/408 |

*Primary Examiner*—Robert Segal
*Attorney, Agent, or Firm*—Ralph E. Clarke, Jr.

[57] ABSTRACT

This disclosure depicts a color television picture tube having an evacuated envelope, an electron gun, a color selection electrode defining a pattern of electron beam passing apertures and a multi-color image screen. The image screen has a corresponding pattern of triads of red-light-emissive, blue-light-emissive and green-light-emissive phosphor elements. The elements are spaced each from one another by a light absorbing material. The tube is characterized by having within at least selected triads in said pattern of triads a first phosphor element and associated electron beam landing area with either a positive or negative tolerance condition. The remaining two phosphor elements and associated beam landing areas have an opposite tolerance condition to that obtained for the first phosphor element.

5 Claims, 7 Drawing Figures

COLOR TELEVISION PICTURE TUBE IMAGE SCREEN HAVING POSITIVE AND NEGATIVE MISREGISTRATION TOLERANCE CONDITIONS

CROSS-REFERENCE TO RELATED APPLICATIONS

This application relates to, but is no way dependent upon copending application of common ownership Ser. No. 363,787, filed May 24, 1973 now U.S. Pat. No. 3,988,632.

BACKGROUND OF THE INVENTION

The present invention relates generally to color television picture tubes used in color reproduction and, more particularly, to color television picture tubes affording increased brightness.

In color television picture tubes of the type with which the present invention is concerned, it is common to provide an evacuated envelope made of glass having an enlarged end carrying a faceplate, and at its opposite end a neck portion containing an electron gun for projecting a beam of electrons toward an image screen on the rear surface of the faceplate. The energy of the electrons is converted into light by the image screen which is comprised of a suitable phosphor layer. The color television picture tube is preferably provided with an image screen which is differentiated from point to point in that adjacent elements of different phosphor material produce light of different colors. A color-selection electrode, usually a multi-apertured mask and conventionally made of a very thin metal sheet which is opaque to the passage of electrons, is disposed between the electron gun and the image screen and is adjacent to the screen. The mask is provided with a large number of small, closely spaced apertures geometrically related to the different phosphor elements on the screen in a predetermined manner. The relation of the apertures to the phosphor elements and the electron beam sources is such that, by appropriate placement of the electron beam apparent sources, different phosphor elements, producing predetermined color emission, can be selectively energized to produce a visible picture corresponding to the original scene.

In some color tubes, the apertures of the mask are of such size that the electron beam impinges only a portion of the respective phosphor elements. The difference between the actual size of the phosphor element and the area impinged by the electron beam constitutes a misregistration tolerance condition or a guard ring which provides a safety factor for preventing color contamination owing to various mechanical, thermal and electrical errors. This tolerance condition is termed a positive misregistration tolerance condition.

A color television picture tube, disclosed in Patent No. 3,146,368, comprises within an evacuated envelope: a multi-color image screen including a plurality of interspersed groups of similarly shaped phosphor elements, each of the phosphor elements being spaced from all adjacent such elements by intermediate light absorbing material; electron gun means for projecting a corresponding plurality of electron beam components towards the image screen; and means, including a color-selection electrode provided with a plurality of apertures individually larger or wider than the phosphor elements and disposed between the screen and the electron gun means, causing a beam landing area larger (or wider) than the size of the phosphor element, and thus establishing a negative misregistration tolerance condition.

The referent copending application discloses and claims a color television picture tube having an image screen including a pattern of red-light-emitting, blue-light-emitting and green-light-emitting phosphor elements. Electron gun means generates first, second and third angularly spaced electron beams for exciting the phosphor elements. A color-selection electrode is disposed adjacent the screen and has a pattern of apertures for causing the first, second and third electron beams to impinge exclusively on the red-light-emitting, blue-light-emitting and green-light-emitting phosphor elements, respectively. The apertures in the color-selection electrode and the phosphor elements are dimensioned relative to each other such that beam landing areas formed by the mask apertures and the respectively associated phosphor elements have a relative dimensional difference which varies between the central portion and the peripheral portions of the image screen from a condition in which the beam landing areas have a greater dimension than the associated phosphor elements (negative tolerance condition) to a condition in which the beam landing areas have a dimension smaller than the associated phosphor elements (positive tolerence condition). The screen has light absorptive material between the phosphor elements in at least those portions of the screen wherein the beam landing area dimension is larger than the associated phosphor element dimension.

In a conventional color television picture tube having an electron gun assembly the first gun to bloom marks the limit of the tube drive since current-limited circuitry is not involved. The green-light-emissive phosphor element takes the most beam current and therefore the electron gun which energizes the green-light-emissive phosphor element is the first to bloom. This limit on brightness occurs in color television picture tubes irrespective of whether they have positive tolerance conditions or negative tolerance conditions.

Other Prior Art

British Pat. No. 1,348,677.

Object of the Invention

It is a general object of the present invention to provide a color television picture tube having increased brightness.

Brief Description of the Drawings

The features of the present invention which are believed to be novel are set forth with particularity in the appended claims. The invention together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
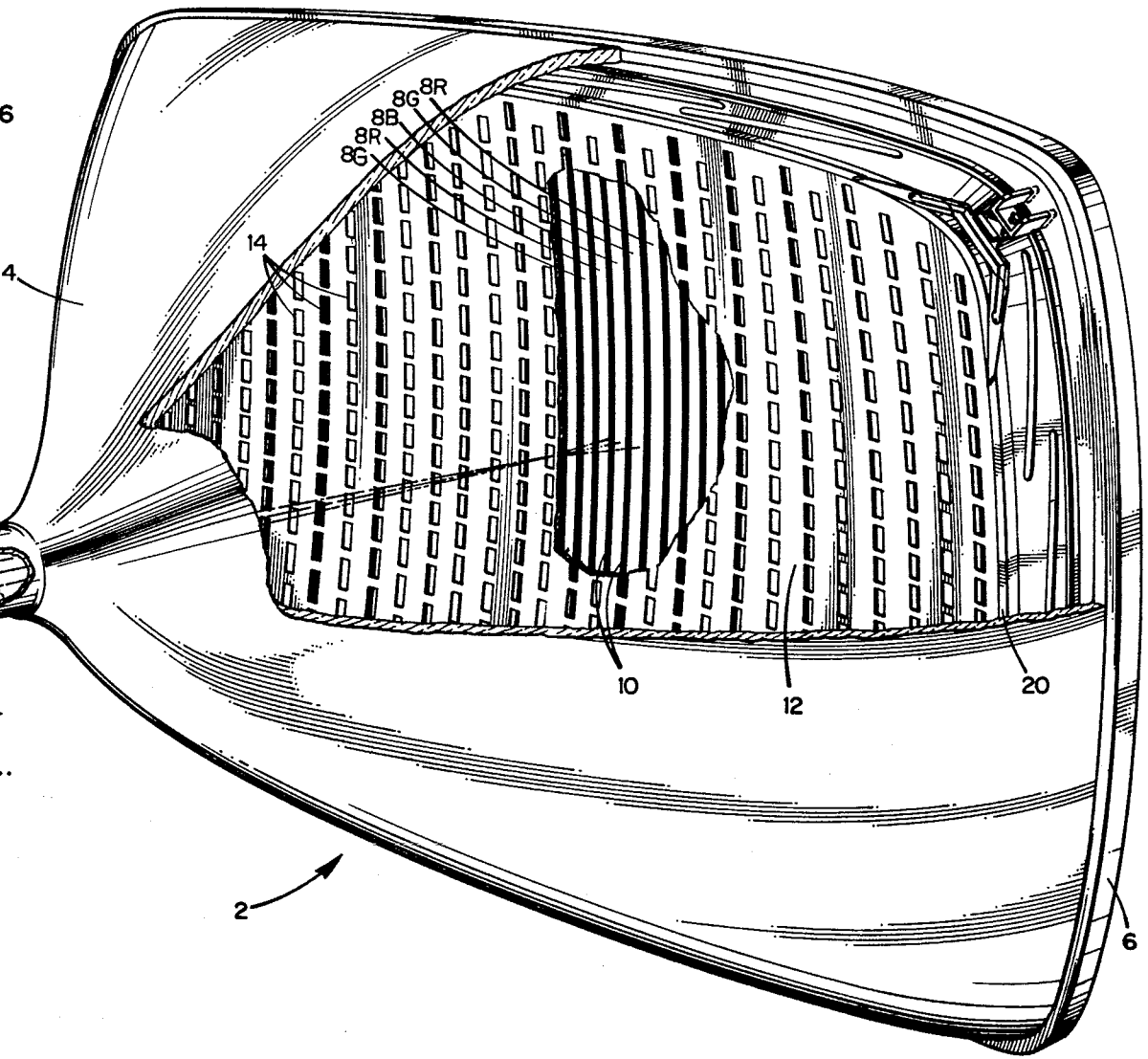
PRIOR ART Fig. 1.
FIG. 1 is a perspective view of a prior art color television picture tube partly broken away to reveal a tricolor, line-type image screen having a plurality of triads of red-light-emissive, blue-light-emissive and green-light-emissive phosphor elements, the elements being spaced each from one another by light-absorbing material.

A color television picture tube 2 having a glass funnel 4 sealed to a flangeless faceplate 6 is shown in FIG. 1. Three electron guns 54, 56 and 58 are contained in the neck 46 of the tube 2. The three electron guns 54, 56 and 58 are electrically connected to pins 66 through base 68 and are arranged to emit respective electron beam components 60, 62 and 64. In the FIG. 1 tube the electron guns are disposed in an in-line arrangement, but the guns could be disposed in a triangular arrangement or other suitable interrelationship depending upon the other structural features of the tube construction. Alternatively, a single electron gun can be used in conjunction with an auxiliary color switching deflection system for deflecting the electron beam to sequentially produce three separate electron beam components.

The electron beam components 60, 62 and 64 are accelerated in a known manner to pass through a deflection field produced by scanning signals applied to a yoke member (not shown) which is positioned about the neck of 46 of the tube 2 adjacent to the funnel portion 4. This deflection field changes the course of the electron beam components in accordance with the instantaneous sweep signals applied to the yoke member. After being deflected the electron beam components 60, 62 and 64 are directed through apertures 14 in a color selection electrode or shadow mask 12 to impinge on the scanning side of a multi-color image screen composed of red-light-emissive phosphors 8R, green-light-emissive phosphors 8G, blue-light-emissive phosphors 8B, and a light-absorbing area 10, the image screen being disposed on the inside surface of the faceplate 6.

The aperture shadow mask 12 may include a plurality of apertures 14 that are slits in the form of narrow, rectangular openings. Adjacent phosphor elements form triads which correspond in position to each aperture in the mask 12 in such a manner that the electron beam components 60, 62 and 64 selectively impinge upon corresponding phosphor elements. See FIG. 2. The mask 12 may also be formed with circular apertures with corresponding circular areas of phosphor elements on the screen portion. Regardless of the particular configuration of the mask and of the image screen, the electron beam components are directed through the apertures in the mask to impinge selectively upon respective phosphor elements of the screen.

The different groups of phosphor elements on the screen, regardless of the configuration of the phosphor elements, possess different color emission characteristics, each element emitting light of a different one of the elemental or primary colors when excited by the incidence of an electron beam. Different phosphor materials are used for producing the component colors of green, blue and red.

Figure 2:
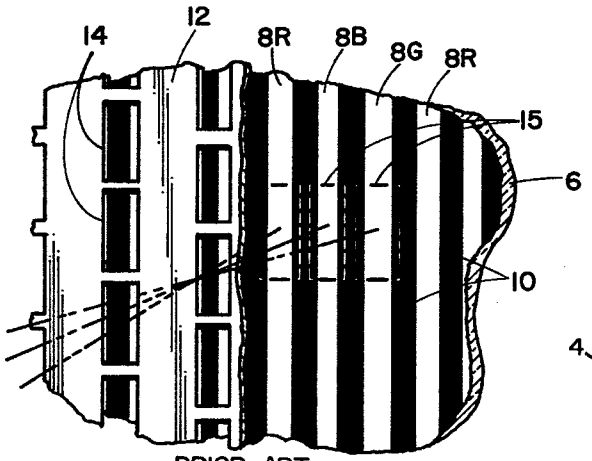
PRIOR ART Fig. 2
FIG. 2 shows an enlarged portion of the image screen of the FIG. 1 tube showing that the phosphor elements and their associated beam landing areas have a negative tolerance condition.
Figure 3:
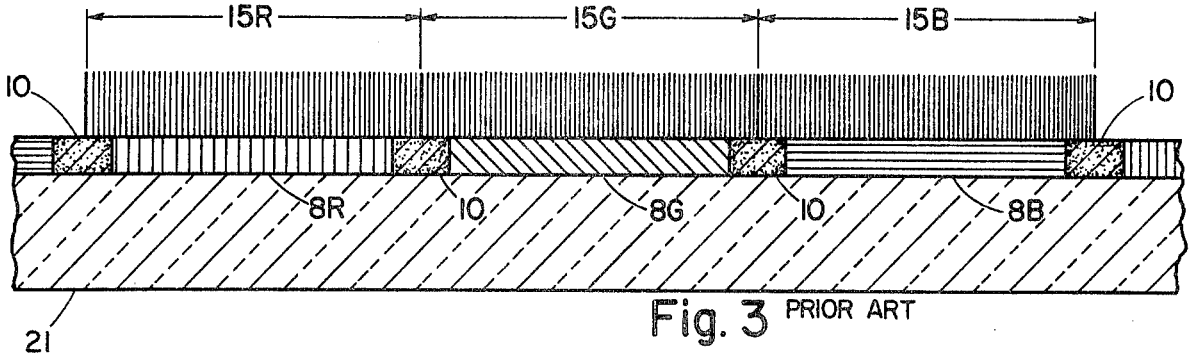
Fig. 3 PRIOR ART
FIGS. 3 and 4 are schematic cross-sectional representations of prior art tri-color line-type image screens having a negative tolerance condition between the phosphor elements and their corresponding beam landing areas.

The relative positioning of the apertures 14 in the mask 12 with regard to the arrangement of the phosphor elements 8R, 8B and 8G on a multi-color screen is shown at larger scale in FIG. 2 of the drawings. These phosphor elements are arranged in triads and are related to one of the apertures 14 in the mask 12. Preferably an electron-transparent aluminum or other conductive layer (not shown) covers the entire rear surface of the screen to provide increased brightness as well as to provide convenient means for maintaining the screen at the operational potential. An aperture 14 in the shadow mask 12 creates a beam landing area 15 when a beam component passes through the aperture 14. FIG. 2 shows beam landing areas 15 which have a negative tolerance condition with regard to the phosphor elements 8R, 8B, and 8G on which the electron beam component impinges. In a negative tolerance condition the beam landing area 15 is larger or wider than the elemental phosphor size at least in the beam scanning direction, by a predetermined misregistration tolerance value; thus part of the beam component impinges upon the light-absorbing material 10 of the screen. This negative tolerance condition is disclosed in U.S. Pat. No. 3,146,368 issued to Fiori et al and is schematically illustrated in FIG. 3 of the drawing showing a cross-sectional view of the image screen deposited on the rear surface of a faceplate 21. As depicted in FIG. 3 light-absorbing material 10 has a width of 2.0 mils and each of the three phosphor elements 8R, 8G and 8B has a width of 10.0 mils. Beam landing areas 15R, 15G and 15B each have a width of 12.0 mils.

Figure 4:
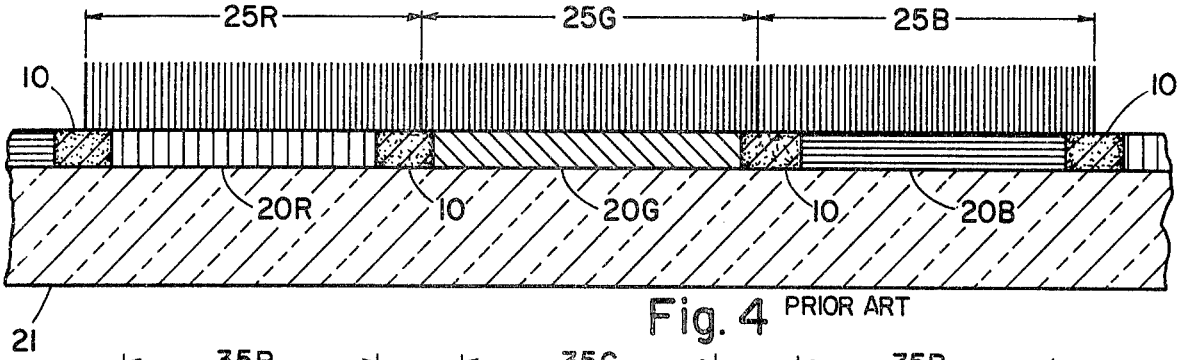
Fig. 4 PRIOR ART

FIG. 4 shows another example of a negative tolerance condition, which is also disclosed in U.S. Pat. No. 3,146,368, wherein a green-light-emissive phosphor element 20G is wider than a red-light-emissive 20R or blue-light-emissive phosphor element 20B. By increasing the width of the green-light-emissive phosphor element, a larger portion of the electron beam landing area covers the phosphor; thus causing the phosphor to emit more light for the same amount of electron gun drive. The electron gun drives for the red-light-emissive and blue-light-emissive phosphor elements are increased so that these phosphor elements also emit more light, and thus the total brightness of the tube is increased. As depicted in FIG. 4 light absorbing material 10 has a width of 2.0 mils, each of the phosphor elements 20R and 20B has a width of 9.5 mils, and phosphor element 20G has a width of 11.0 mils. Beam landing areas 25R, 25G and 25B each have a width of 12.0 mils.

Figure 5:
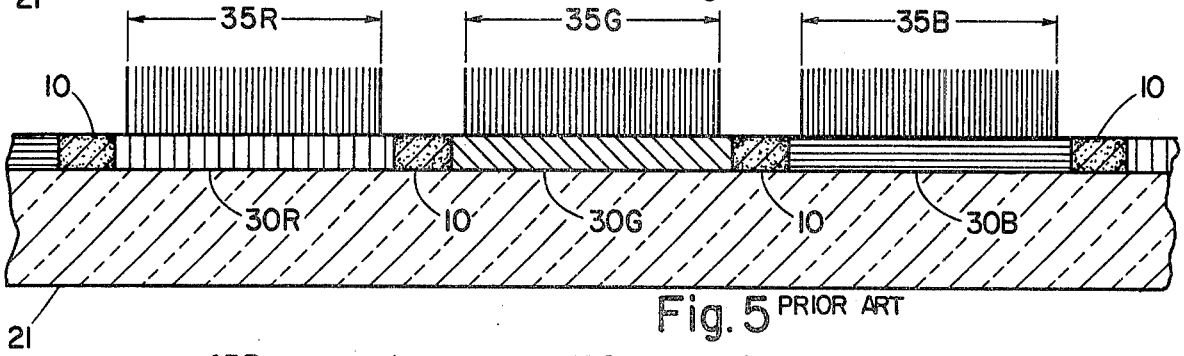
Fig. 5 PRIOR ART
FIG. 5 is a schematic cross-section representation of a prior art tri-color line-type image screen having a positive tolerance condition between the phosphor elements and their corresponding beam landing areas.

A positive tolerance condition occurs when an electron beam component which passes through an aperture in the shadow mask has a beam landing area smaller (or narrower) by a predetermined misregistration tolerance value than the impinged phosphor element (see FIG. 5). As depicted in FIG. 5 light-absorbing material 10 has a width of 2.0 mils and each of the three phosphor elements 30R, 30G, and 30B has a width of 10.0 mils. Beam landing areas 35R, 35G and 35B each have a width of 9.0 mils.

In color television picture tubes the limit of usable brightness is determined by the amount of current which can be supplied to the electron gun before the electron gun blooms. In a tri-color electron gun assembly using todays phosphors, the first electron gun to bloom as the brightness is increased is the electron gun that is used to illuminate the green-light-emissive phosphor element. The first gun, that is the gun which energizes the green-light-emissive phosphor element, to bloom marks the limit of tube drive since current-limited circuitry is not involved. Therefore an increase in brightness is possible if for the same given current drive of the green electron gun the green-light-emissive phosphor element can be made to emit more light. Then the current drive for the blue electron gun and the red electron gun can be increased in necessary proportion to cause the red-light-emissive and blue-light-emissive phosphor elements to emit more light. Applicant's invention provides for this increased brightness by a novel approach utilizing both positive and negative misregistration tolerance conditions for the beam landing areas and phosphor elements.

The present invention will now be described. The present invention provides for a color television picture tube having an evacuated envelope, an electron gun, a color selection electrode defining a pattern of electron beam passing apertures and a multi-color image screen. The image screen has a corresponding pattern of triads of red-light-emissive, blue-light-emissive and green-light-emissive phosphor elements. The elements are spaced each from one another by a light absorbing material. The tube is characterized by having within at least selected triads in said pattern of triads a first phosphor element and associated electron beam landing area with either a positive or negative misregistration tolerance condition. The remaining two phosphor elements and associated electron beam landing areas have an opposite tolerance condition to that obtained for the first phosphor element.

In the disclosed preferred embodiment, the present invention provides a color television picture tube having an evacuated envelope, a multi-color image screen wherein the screen has a pattern of traids of red-light-emissive, blue-light-emissive and green-light-emissive phosphor elements. The elements are spaced each from one another by a light absorbing material. An electron gun for projecting a plurality of electron beam components towards the image screen, and means including a color selection electrode provided with a corresponding pattern of electron beam passing apertures disposed between the screen and the electron gun, for selectively masking the electron beam components to define electron beam landing areas on the phosphor elements, are also provided in the color television picture tube. The apertures in the color selection electrode have predetermined sizes to produce beam landing areas of predetermined sizes. The tube is characterized by at most two of the phosphor elements in each of the triads being wider than the corresponding beam landing areas, at least in the direction of electron beam scan, to provide a positive misregistration tolerance condition. The remaining phosphor element or elements in each of the triads are narrower than the remaining of the associated beam landing areas to provide a negative misregistration tolerance condition.

Figure 6:
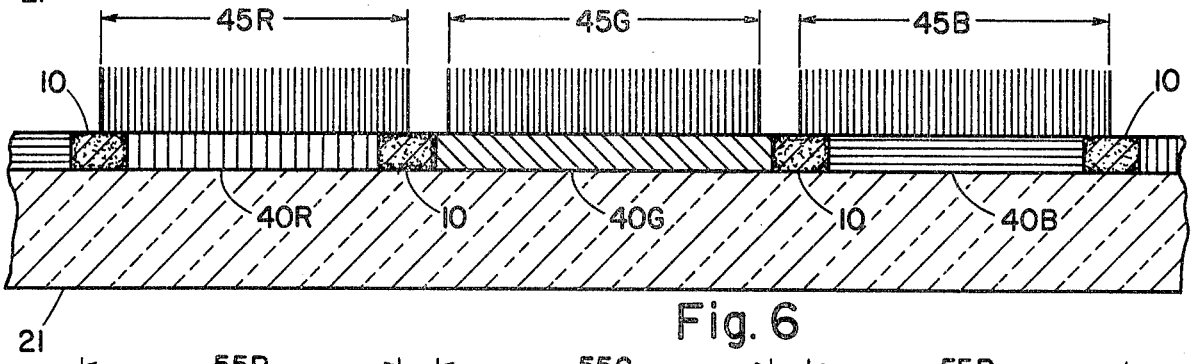
FIGS. 6 and 7 are schematic representations of the principles of this invention as applied to a tri-color line-type image screen.

FIG. 6 schematically illustrates an embodiment of the present invention. FIG. 6 depicts a cross-section of a tri-color line-type image screen deposited on the rear surface of a faceplate 21. The red-light-emissive phosphor stripe element 40R, the green-light-emissive phosphor stripe element 40G, and the blue-light-emissive phosphor stripe element 40B are spaced each from one another by light absorbing material 10. Beam landing areas 45R and 45B and phosphor elements 40R and 40B have negative misregistration tolerance conditions. That is, in the electron beam scanning direction the beam landing area covers the entire phosphor element as well as a predetermined, tolerance related portion of the light absorbing material 10. However, beam landing area 45G being narrower than green-light-emissive phosphor element 40G creates a positive tolerance condition for this phosphor element. Thus, the entire amount of energy in the electron beam component for the green-light-emissive phosphor element 40G is converted into visible light by the phosphor element 40G. No amount of energy is lost due to impingement on the light absorbing area 10. Therefore, the current drive for the electron guns corresponding to the blue-light-emissive phosphor element 40B and red-light-emissive phosphor element 40R may be increased in order to provide more light from the red-light-emissive and blue-light-emissive phosphor elements 40R, 40B to match the increased light output gained from the green-light-emissive phosphor element 40G, providing an overall increase in brightness of the color television picture tube. This increase in brightness may be as much as 10 percent of the normal brightness exhibited in a conventional color television picture tube with a negative tolerance condition.

As depicted in FIG. 6 light absorbing material 10 has a width of 2.0 mils, each of the phosphor elements 40R and 40B has a width of 9.0 mils, and phosphor element 40G has a width of 12.0 mils. Beam landing areas 45R, 45G and 45B each have a width of 11.0 mils.

Figure 7:
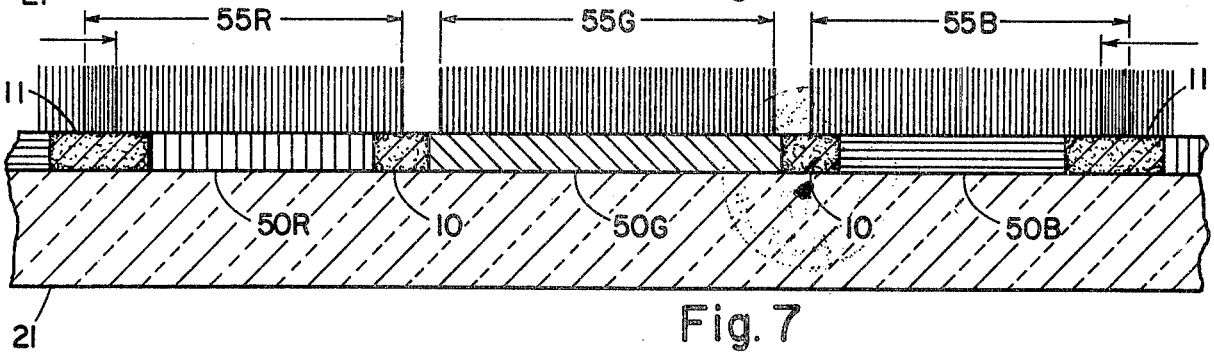

FIG. 7 shows an alternative embodiment of the present invention wherein the green-light-emissive phosphor stripe element 50G is even wider in size than in the FIG. 6 embodiment and allows the beam landing area 55G to be increased by the use of a larger aperture in the shadow mask. Green-light-emissive phosphor element 50G is larger in width than phosphor elements 50R and 50B. Beam landing areas 55R and 55B on the phosphor elements 50R and 50B exhibit a negative tolerance condition whereas the beam landing area 55G on phosphor element 50G exhibits a positive tolerance condition. Increasing the width of the green-light-emissive phosphor element 50G and the use of a larger electron beam landing area enables the generation of additional light from this phosphor element. The current drive of the red and blue electron guns may be increased to provide more light from the red-light-emissive and blue-light-emissive phosphor stripe elements and thus increase the overall brightness of the tube. In this embodiment due to the increased size of the beam landing areas, the beam landing area for a blue-light-emissive phosphor element of one triad overlaps the beam landing area of a red-light-emissive phosphor element of the adjoining triad. This overlap occurs on the light absorbing material 11 which is wider than light absorbing material 10 in order to accommodate the overlap.

As depicted in FIG. 7 light absorbing material 10 and 11 have widths of 2.0 mils and 3.5 mils, respectively. Each of the phosphor elements 50R and 50B has a width of 8.0 mils, and phosphor element 50G has a width of 12.5 mils. Beam landing areas 55R, 55G and 55B each have a width of 11.5 mils.

The following chart shows a comparison of the embodiments of the present invention with negative tolerance television picture tubes. Brightness capabilities as well as clipping and leaving tolerances are indicated in the chart.

| | Neg. Gd. Band Fig. 3 | Neg. Gd. Band (Unequal Size) Fig. 4 | Neg/Pos. Gd. Band Fig. 6 11 mil excited Green Phosphor | Neg/Pos. Gd. Band Fig. 7 11.5 mil excited Green Phosphor |
|---|---|---|---|---|
| Triad Size | 36 mil | 36 mil | 36 mil | 36 mil |
| Beam Landing Size | 12 mil | 12 mil | 11 mil | 11.5 mil |
| Black Width | 2 mil | 2 mil | 2 mil | 2,2, 3½ mil |
| Blue and Red Phosp. Width | 10 mil | 9.5 mil | 9 mil | 8 mil |
| Green Phosp. Width | 10 mil | 11 mil | 12 mil (11 mil excited) | 12.5 mil (11.5 mil excited) |
| Rel. Brightness for green limited current | 100% | 110% | 110% | 115% |
| Rel. Brightness (equal total current) | 100% | 101.4% | 99% | 93% |

| Tolerances (mil) | | R | G | B | R | G | B | R | G | B | R | G | B |
|---|---|---|---|---|---|---|---|---|---|---|---|---|---|
| | R | −1 | +1 | +1 | −1¼ | +¾ | +¾ | −1 | +1 | +1 | −1 −2½ | +1 | +1 |
| | G | +1 | −1 | +1 | +1⅛ | −½ | +1½ | 2−½ | −½ | 2−½ | +2½ | −½ | +2½ |
| | B | +1 | +1 | −1 | +¾ | +¾ | −1¼ | +1 | +1 | −1 | +1 | +1 | −1 −2½ |

+ = clipping tolerances
− = leaving tolerances

The invention is not limited to the particular details of the apparatus depicted and other modifications and applications are contemplated. Certain changes may be in the above-described apparatus without departing from the true spirit and scope of the invention herein involved. It is intended, therefore, that the subject matter in the above depiction shall be interpreted as illustrative and not in a limiting sense.

What is claimed is:

1. A color television picture tube having an evacuated envelope; an electron gun; a color selection electrode defining a pattern of electron beam passing apertures; and a multi-color image screen having a corresponding pattern of triads of red-light-emissive, blue-light-emissive, and green-light-emissive phosphor elements, the elements being spaced each from one another by a light-absorbing material, said tube being characterized by having within at least selected triads in said pattern of triads a first phosphor element and associated electron beam landing area with either a positive or negative misregistration tolerance condition and the remaining two phosphor elements and associated beam landing areas with an opposite tolerance condition to that obtaining for said first phosphor element.

2. A color television picture tube having an evacuated envelope; and electron gun; a color selection electrode defining a pattern of electron beam passing apertures; and a tri-color line-type image screen having a corresponding pattern of triads of red-light-emissive, blue-light-emissive, and green-light-emissive phosphor elements, the elements being spaced each from one another by a light-absorbing material, said tube being characterized by having within at least selected triads in said pattern of triads a green-light-emissive phosphor element and associated electron beam landing area with a positive misregistration tolerance condition, and a red-light-emissive phosphor element and associated electron beam landing area and a blue-light-emissive phosphor element and associated electron beam landing area with a negative tolerance condition.

3. A color television picture tube having an evacuated envelope; a multi-color image screen, said screen having a pattern of triads of red-light-emissive, blue-light-emissive, and green-light-emissive phosphor elements, the elements being spaced each from one another by a light-absorbing material; an electron gun for projecting a plurality of electron beam components towards said image screen; and means including a color selection electrode defining a corresponding pattern of electron beam passing apertures disposed between said screen and said electron gun for selectively masking said electron beam components to define electron beam landing areas on said phosphor elements, said apertures having predetermined sizes to produce beam landing areas of predetermined sizes the tube being characterized by:

at most two of said phosphor elements in each of said triads being wider than said corresponding beam landing area, at least in the direction of electron beam scan, to provide a positive misregister tolerance condition;

the remaining of said phosphor elements in each of said triads each being narrower than the remaining of said associated beam landing areas to provide a negative misregister tolerance condition.

4. A color television picture tube having an evacuated envelope; a tri-color line-type image screen, said screen having a pattern of triads of red-light-emissive, blue-light-emissive, and green-light-emissive phosphor stripe elements, the elements being spaced each from one another by a light-absorbing material; and electron gun for projecting a plurality of electron beam components towards said image screen; and means including a color selection electrode defining a corresponding pattern of electron beam passing slots disposed between said screen and said electron gun for selectively masking said electron beam components to define electron beam landing areas on said phosphor elements, said slots having predetermined sizes to produce beam landing areas of predetermined sizes, the tube being characterized by:

a green-light-emissive phosphor stripe element in each of said triads being wider than said corresponding beam landing area, at least in the direction of electron beam scan to provide a positive misregistration tolerance condition;

a red-light-emissive phosphor stripe element and a blue-light-emissive phosphor stripe element in each of said triads each being narrower than the remaining of said associated beam landing areas to provide a negative misregistration tolerance condition.

5. The apparatus defined in claim 4 wherein a first beam landing area of an electron beam component corresponding to said red-light-emissive phosphor stripe element of a first triad overlaps a second beam landing area of an electron beam component corresponding to said blue-light-emissive phosphor stripe element of a second triad, wherein said overlap occurs on said light absorbing material.

* * * * *